US009709948B2

(12) United States Patent
Wakimoto

(10) Patent No.: US 9,709,948 B2
(45) Date of Patent: Jul. 18, 2017

(54) COVER OPENING/CLOSING MECHANISM AND IMAGE FORMING APPARATUS THEREWITH

(71) Applicant: KYOCERA Document Solutions Inc., Osaka (JP)

(72) Inventor: Atsuhiro Wakimoto, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 15/179,275

(22) Filed: Jun. 10, 2016

(65) Prior Publication Data

US 2016/0363905 A1 Dec. 15, 2016

(30) Foreign Application Priority Data

Jun. 15, 2015 (JP) ..... 2015-119907

(51) Int. Cl.
*G03G 21/16* (2006.01)

(52) U.S. Cl.
CPC ... *G03G 21/1633* (2013.01); *G03G 2221/169* (2013.01); *G03G 2221/1627* (2013.01)

(58) Field of Classification Search
CPC ..... G03G 21/1633; G03G 2221/169; G03G 2221/1627; G03G 15/168
See application file for complete search history.

(56) References Cited

U.S. PATENT DOCUMENTS 4,754,293 A * 6/1988 Aizawa ..... G03G 15/30 271/186
6,975,821 B2 * 12/2005 Suzuki ..... G03G 15/0898 399/107
7,542,699 B2 * 6/2009 Kawasaki ..... B41J 29/13 399/110
8,594,532 B2 * 11/2013 Cook ..... E05F 5/02 399/124
2005/0095027 A1 * 5/2005 Hatakeyama ..... G03G 15/5058 399/98
2005/0163518 A1 * 7/2005 Onose ..... G03G 15/5062 399/49
2005/0196217 A1 * 9/2005 Nishimura ..... G03G 15/6552 400/693

(Continued)

FOREIGN PATENT DOCUMENTS

JP 62118341 A * 5/1987
JP 5-81481 A 4/1993

(Continued)

*Primary Examiner* — David M Gray
*Assistant Examiner* — Laura Roth
(74) *Attorney, Agent, or Firm* — Stein IP, LLC

(57) ABSTRACT

A cover opening/closing mechanism includes an opening/closing cover, a moving member, a first biasing member, a gear, and a damper. The opening/closing cover is pivotable about a rotary shaft. The moving member, as the opening/closing cover is opened and closed, reciprocates, while in contact with the opening/closing cover, in a first positive direction and a first negative direction. The first biasing member biases in the first positive direction the moving member that moves in the first negative direction as the opening/closing cover is rotated in the closing direction. The gear is coupled with the opening/closing cover. The damper generates a load according to the rotation speed of the gear.

10 Claims, 11 Drawing Sheets

(56) References Cited

U.S. PATENT DOCUMENTS

| | | | | |
|---|---|---|---|---|
| 2008/0034909 | A1* | 2/2008 | Ishii | B41J 29/13 74/414 |
| 2011/0097111 | A1* | 4/2011 | Takayama | G03G 21/169 399/124 |
| 2011/0262178 | A1* | 10/2011 | Tsuchiya | G03G 21/169 399/98 |
| 2014/0072333 | A1* | 3/2014 | Yamashita | G03G 21/1623 399/110 |
| 2016/0018780 | A1* | 1/2016 | Sugiyama | G03G 21/1633 399/110 |
| 2016/0159588 | A1* | 6/2016 | Mizuguchi | B65H 31/26 271/147 |

FOREIGN PATENT DOCUMENTS

| | | | | |
|---|---|---|---|---|
| JP | H05-81481 | U | | 11/1993 |
| JP | 07237655 | A | * | 9/1995 |
| JP | 2006083551 | A | * | 3/2006 |

* cited by examiner

COVER OPENING/CLOSING MECHANISM AND IMAGE FORMING APPARATUS THEREWITH

INCORPORATION BY REFERENCE

This application is based upon and claims the benefit of priority from the corresponding Japanese Patent Application No. 2015-119907 filed on Jun. 15, 2015, the entire contents of which are incorporated herein by reference.

BACKGROUND

The present disclosure relates to a cover opening/closing mechanism and to an image forming apparatus incorporating the cover opening/closing mechanism. More particularly, the present disclosure relates to a cover opening/closing mechanism including a pivotable opening/closing cover and to an image forming apparatus incorporating such a cover opening/closing mechanism.

Conventionally, some image forming apparatuses such as printers, copiers, facsimile machines, etc., are known to be provided with a pivotable opening/closing cover on the top surface of an apparatus main body for replacing toner, handling a jam, etc. Although such opening/closing covers are intrinsically lightweight, more and more opening/closing covers have come to be fitted with a heavy object such as a display panel as touch panel-type operation panels are increasingly widespread in recent years, and also for improved operability.

SUMMARY

According to one aspect of the present disclosure, a cover opening/closing mechanism includes an opening/closing cover, a moving member, a first biasing member, a gear, and a damper. The opening/closing cover is pivotable about a rotary shaft. The moving member, as the opening/closing cover is opened and closed, reciprocates, while in contact with the opening/closing cover, in a first positive direction and a first negative direction opposite to the first positive direction. The first biasing member biases in the first positive direction the moving member that moves in the first negative direction as the opening/closing cover is rotated in the closing direction. The gear is coupled with the opening/closing cover and rotates as the opening/closing cover is opened and closed. The damper is coupled with the gear, and suppresses an increase in the rotation speed of the gear by generating a load according to the rotation speed.

Further features and advantages of the present disclosure will become apparent from the description of embodiments given below.

DETAILED DESCRIPTION

Hereinafter, embodiments of the present disclosure will be described with reference to the accompanying drawings.

Figure 1:
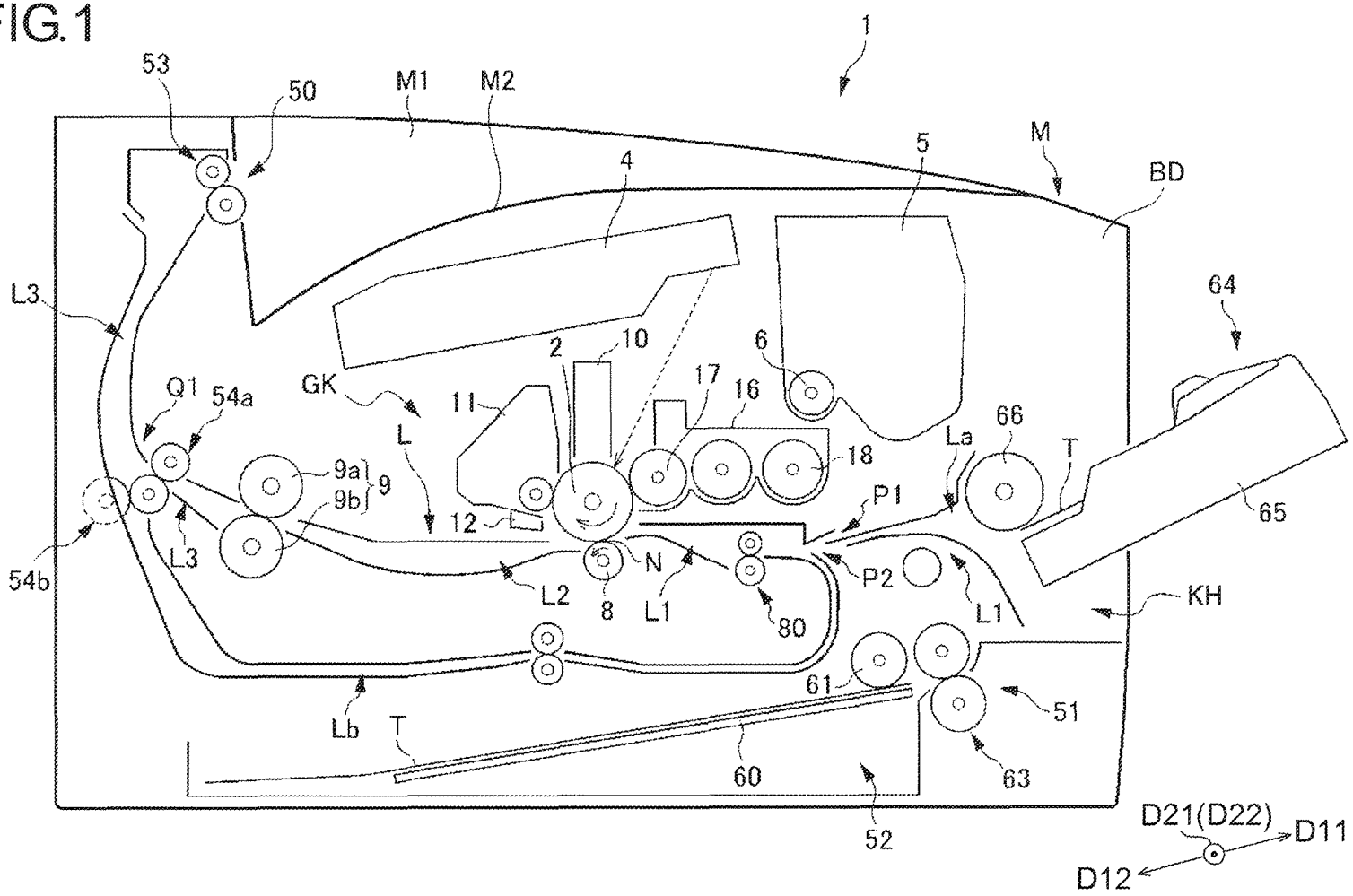
FIG. 1 is a diagram showing the construction of an image forming apparatus according to one embodiment of the present disclosure.
Figure 2:
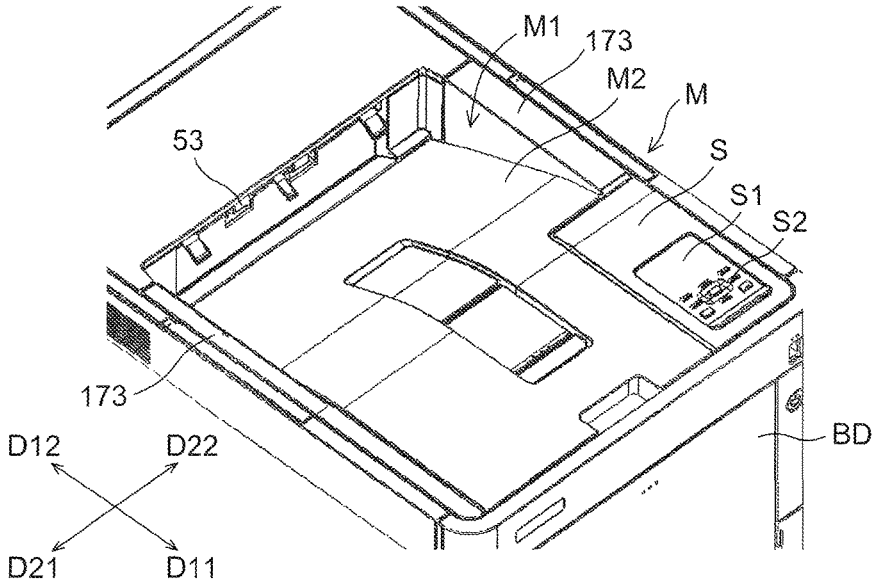
FIG. 2 is a diagram showing an upper part of the image forming apparatus according to one embodiment of the present disclosure as seen from the front side (the right side in FIG. 1), and is a diagram showing a state in which a top cover member is closed.

FIG. 1 is a diagram showing the structure of an image forming apparatus 1 according to one embodiment of the present disclosure. FIG. 2 is a diagram showing an upper part of the image forming apparatus 1 as seen from the front side (the right side in FIG. 1). Here, as the image forming apparatus 1, a monochrome printer is shown.

The image forming apparatus 1 includes an apparatus main body M, an image forming portion GK for forming a predetermined toner image on a sheet T as a sheet-form transfer material based on predetermined image data, and a sheet feed/discharge portion KH for feeding a sheet T to the image forming portion GK and for discharging the sheet T that has a toner image formed thereon. The exterior shape of the apparatus main body M is formed by a case body BD as a housing.

As shown in FIG. 1, the image forming portion GK includes a photosensitive drum 2 as an image carrying member (photosensitive member) and includes, along the surface of the photosensitive drum 2 from the upstream side to the downstream side with respect to its rotation direction, a charging portion 10, an LSU (laser scanner unit) 4 as an exposure unit, a developing device 16, a transfer roller 8, a destaticizer 12, and a drum cleaning portion 11. On the downstream side of the image forming portion GK with respect to the sheet transport direction, a fixing portion 9 is arranged. The sheet feed/discharge portion KH includes a sheet feed cassette 52, a manual sheet feed portion 64, a transport passage L for a sheet T, a registration roller pair 80, and a sheet discharge portion 50. Below, the structures of the image forming portion GK and the sheet feed/discharge portion KH will be described in detail.

In the image forming portion GK, the surface of the photosensitive drum 2 is subjected to, sequentially in the order mentioned, the processes of electrostatic charging by the charging portion 10, exposure to light by the LSU 4, image development by the developing device 16, image transfer by the transfer roller 8, destaticizing by the destaticizer 12, and cleaning by the drum cleaning portion 11.

The photosensitive drum 2 is, for example, a drum pipe of aluminum laid with a photosensitive layer, and is arranged so as to be rotatable in the direction indicated by an arrow about a rotary shaft as a center which extends in a direction orthogonal to the transport direction of a sheet T in the sheet transport passage L. The photosensitive layer is electrostatically charged by the charging portion 10 as will be described later, and, on the photosensitive layer, when it receives a laser beam from the LSU 4, an electrostatic latent image with attenuated electrostatic charge is formed. There is no particular restriction on the photosensitive layer, which preferably is, for example, a layer of amorphous silicon (a-Si), which excels in durability, or an organic photosensitive layer (OPC), which generates little ozone when electrostatically charged and which produces a high-resolution image, or the like.

The charging portion 10 is arranged opposite the surface of the photosensitive drum 2, and electrostatically charges uniformly, either negatively (with a negative polarity) or positively (with a positive polarity), the photosensitive layer on the surface of the photosensitive drum 2. The LSU 4 is arranged apart from the surface of the photosensitive drum 2, and includes a laser light source, a polygon mirror, a motor for driving the polygon mirror etc., of which none is illustrated.

The developing device 16 serves to form a toner image by attaching toner to the electrostatic latent image formed on the photosensitive layer on the surface of the photosensitive drum 2, and includes a developing roller 17 arranged opposite the surface of the photosensitive drum 2, a stirring roller 18 for stirring toner, etc. Toner is fed to the developing device 16 via a toner feeding portion 6 from a toner cartridge 5. Here, one-component developer (hereinafter also referred to simply as toner) containing a magnetic toner component alone is stored in the developing device 16.

The transfer roller 8 transfers, without disturbing, the toner image formed on the surface of the photosensitive drum 2 to a sheet T transported through the sheet transport passage L. To the transfer roller 8 is applied, by an unillustrated transfer bias applying portion, a transfer bias having the opposite polarity to that of the toner.

The destaticizer 12 is arranged opposite the surface of the photosensitive drum 2. The destaticizer 12 removes, by irradiating the surface of the photosensitive drum 2 with light, electric charge from the surface of the photosensitive drum 2 after the toner image thereon has been transferred by the transfer roller 8.

The drum cleaning portion 11 includes a cleaning roller, a cleaning blade, or the like that makes line contact with the photosensitive drum 2 in its longitudinal direction. After the toner image is transferred to a sheet T, the drum cleaning portion 11 removes substances such as toner and toner external additive that remain attached to the surface of the photosensitive drum 2.

The fixing portion 9 fuses and presses the toner that forms the toner image transferred to the sheet T, thereby fixing the toner image on the sheet T. The fixing portion 9 includes a heating roller 9*a* heated by a heater, and includes a pressing roller 9*b* in pressed contact with the heating roller 9*a*. The sheet T is transported while being held in a nip portion (fixing nip portion) between the heating roller 9*a* and the pressing roller 9*b*, and thereby the toner transferred onto the sheet T is fused and pressed so as to be fixed on the sheet T.

Now, the sheet feed/discharge portion KH will be described. As shown in FIG. 1, in a lower part of the apparatus main body M, the sheet feed cassette 52 for storing sheets T is arranged. The sheet feed cassette 52 is fitted to the apparatus main body M so as to be detachable on its front side (the right side in FIG. 1) in the horizontal direction. On the sheet feed cassette 52, there is arranged a sheet placement plate 60 on which sheets T are placed. In the sheet feed cassette 52, sheets T are stored in a state stacked on the sheet placement plate 60.

The sheets T placed on the sheet placement plate 60 are fed into the sheet transport passage L by a cassette sheet feeding portion 51 arranged at a sheet-feeding-side end part of the sheet feed cassette 52 (a right-side end part in FIG. 1). The cassette sheet feeding portion 51 is provided with a feeding mechanism composed of a pick-up roller 61 for taking out the sheets T on the sheet placement plate 60 and a sheet feeding roller pair 63 for feeding the sheets T one after another into the transport passage L.

On the front side of the apparatus main body M (on the right side in FIG. 1), the manual sheet feed portion 64 is provided. The manual sheet feed portion 64 is provided mainly for the purpose of feeding, to the apparatus main body M, sheets T of a size or type different from sheets T set in the sheet feed cassette 52. The manual sheet feed portion 64 includes a manual tray 65 that constitutes a part of the front surface of the apparatus main body M in a closed state and a sheet feeding roller 66. The lower end of the manual tray 65 is pivotably (openably/closably) fitted close to the sheet feeding roller 66. On the manual tray 65 in an open state, sheets T are placed. The sheet feeding roller 66 feeds a sheet T placed on the manual tray 65 in an open state into a manual transport passage La.

On the top side of the apparatus main body M, the sheet discharge portion 50 is provided. The sheet discharge portion 50 discharges a sheet T to outside the apparatus main body M via a third roller pair 53.

The transport passage L through which a sheet T is transported includes a first transport passage L1 from the cassette sheet feeding portion 51 to a transfer nip N, a second transport passage L2 from the transfer nip N to the fixing portion 9, a third transport passage L3 from the fixing portion 9 to the sheet discharge portion 50, a manual transport passage La which feeds a sheet fed from the manual sheet feed portion 64 into the first transport passage L1, and a reverse transport passage Lb through which a sheet transported through the third transport passage L3 from downstream to upstream is returned to the first transport passage L1, with the obverse and reverse sides of the sheet reversed.

Moreover, in the middle of the first transport passage L1, first and second joining portions P1 and P2 are arranged. In the middle of the third transport passage L3, a first branching portion Q1 is arranged. The first joining portion P1 is a joining portion at which the manual transport passage La joins the first transport passage L1. The second joining portion P2 is a joining portion at which the reverse transport passage Lb joins the first transport passage L1. The first branching portion Q1 is a branching portion at which the reverse transport passage Lb branches off the third transport passage L3. The first branching portion Q1 includes first and second roller pairs 54*a* and 54*b*. One roller of the first roller pair 54*a* is shared as one roller of the second roller pair 54*b*.

In the middle of the first transport passage L1 (specifically, between the second joining portion P2 and the transfer roller 8), there are arranged a sensor for detecting a sheet T, and a registration roller pair 80 for correcting for skew of the sheet T (skewed sheet-feeding) and for coordinating with toner image formation in the image forming portion GK. The sensor is arranged immediately before the registration roller pair 80 with respect to the transport direction of a sheet T (on the upstream side with respect to the transport direction). The registration roller pair 80 transports a sheet T while performing the mentioned correction and timing adjustment based on information conveyed by a detection signal from the sensor.

The reverse transport passage Lb is a transport passage provided to make, during double-sided printing on a sheet T, the sheet T face the photosensitive drum 2 at the side (not-yet-printed side) of the sheet T opposite from its already printed side. Thus, with the reverse transport passage Lb, a sheet T transported from the first branching portion Q1 toward the sheet discharge portion 50 by the first roller pair 54*a* can be returned by the second roller pair 54*b* to the first transport passage L1 with the obverse and reverse sides of the sheet reversed so as to be transported to the upstream side of the registration roller pair 80 arranged on the upstream side of the transfer roller 8. To the sheet T with its obverse and reverse sides reversed by the reverse transport passage Lb, a predetermined toner image is transferred on the not-yet-printed side in the transfer nip N.

At an end part of the third transport passage L3, the sheet discharge portion 50 is formed. The sheet discharge portion 50 is arranged on the top side of the apparatus main body M. The sheet discharge portion 50 has an opening that points to the front of the apparatus main body M (to the right side in FIG. 1, that is, the manual sheet feed portion 64-side). The sheet discharge portion 50 discharges a sheet T transported through the third transport passage L3 to outside the apparatus main body M via the third roller pair 53.

On the opening side of the sheet discharge portion 50, a discharge sheet accumulation portion M1 is formed. The discharge sheet accumulation portion M1 is formed on the top surface (outer face) of the apparatus main body M. The discharge sheet accumulation portion M1 is a portion formed as a depression in the top surface of the apparatus main body M. The bottom surface of the discharge sheet accumulation portion M1 is formed by a top cover member M2 as an opening/closing cover which constitutes a part of the top surface of the apparatus main body M. On the top surface of the top cover member M2 that forms the discharge sheet accumulation portion M1, sheets T having predetermined toner images formed thereon and then discharged by the sheet discharge portion 50 are stacked and accumulated. At a predetermined position in each of the transport passages, a sensor (unillustrated) for sheet detection is arranged.

Moreover, as shown in FIG. 2, at a part of the top cover member M2 toward its tip end (free end), an operation portion S is provided. The operation portion S includes a touch panel-type display portion S1 for displaying the status of the image forming apparatus 1, various messages, and setting screens, and includes hardware keys S2. The structure of the top cover member M2 will be described in detail later.

In the image forming apparatus 1 according to the present embodiment, a member moving mechanism 100 that operates in synchronization with opening/closing of the top cover member M2 is incorporated inside the apparatus main body M. The structure of the member moving mechanism 100 will be described in detail later.

Now, image formation in the image forming apparatus 1 according to the present embodiment will be described. During image formation, in the image forming portion GK, the charging portion 10 electrostatically charges uniformly the surface of the photosensitive drum 2, and then the LSU 4 irradiates the surface of the photosensitive drum 2 with a laser beam (a ray of light) based on image data entered from an external device such as a PC (personal computer) so that an electrostatic latent image based on the image data is formed on the surface of the photosensitive drum 2. Thereafter, the developing device 16 attaches toner to the electrostatic latent image, and thereby forms a toner image on the surface of the photosensitive drum 2.

Toward the image forming portion GK in which the toner image has been formed as described above, a sheet T is transported with predetermined timing from the sheet feed cassette 52 (or from the manual tray 65) via the sheet transport passage L and the registration roller pair 80 so that the toner image on the surface of the photosensitive drum 2 is transferred to the sheet T by the transfer roller 8 in the image forming portion GK. Then, the sheet T to which the toner image has been transferred is separated from the photosensitive drum 2 and is transported to the fixing portion 9 to be heated and pressed so that the toner image is fixed on the sheet T.

The sheet T which has passed through the fixing portion 9 is distributed between different transport directions by the first branching portion Q1. When an image is formed only on one side of the sheet T, the sheet T is discharged, as it is, from the sheet discharge portion 50 to the discharge sheet accumulation portion M1 by the third roller pair 53.

On the other hand, when images are formed on both sides of the sheet T, the sheet T having passed through the fixing portion 9 is first transported in the direction of the third roller pair 53. After the tail end of the sheet T passes through the first branching portion Q1, the third roller pair 53 is rotated in the reverse direction so that the sheet T is, starting with its tail end, distributed into the reverse transport passage Lb; thus the sheet T is, with the image side reversed, transported once again to the registration roller pair 80. Then, the next image formed on the photosensitive drum 2 is transferred by the transfer roller 8 to the not-yet-printed side of the sheet T. The sheet T is then transported to the fixing portion 9, where the toner image is fixed, and is then discharged from the sheet discharge portion 50 to the discharge sheet accumulation portion M1.

Next, the structure of the top cover member M2 and the periphery thereof will be described.

Figure 3:
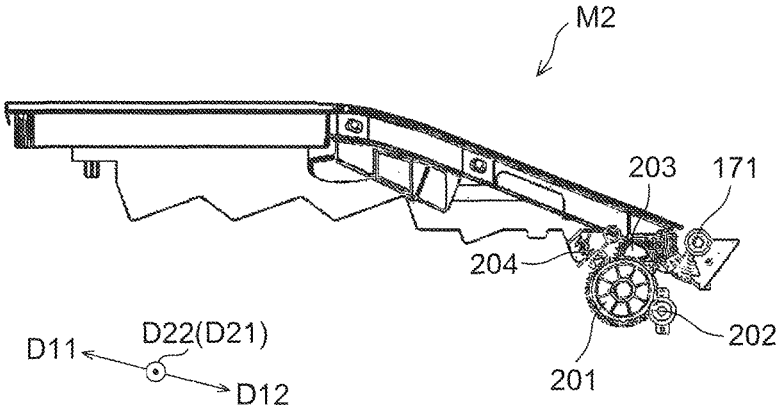
FIG. 3 is a diagram showing the top cover member in a closed state in the image forming apparatus according to one embodiment of the present disclosure as seen from the right side of the top cover member.
Figure 4:
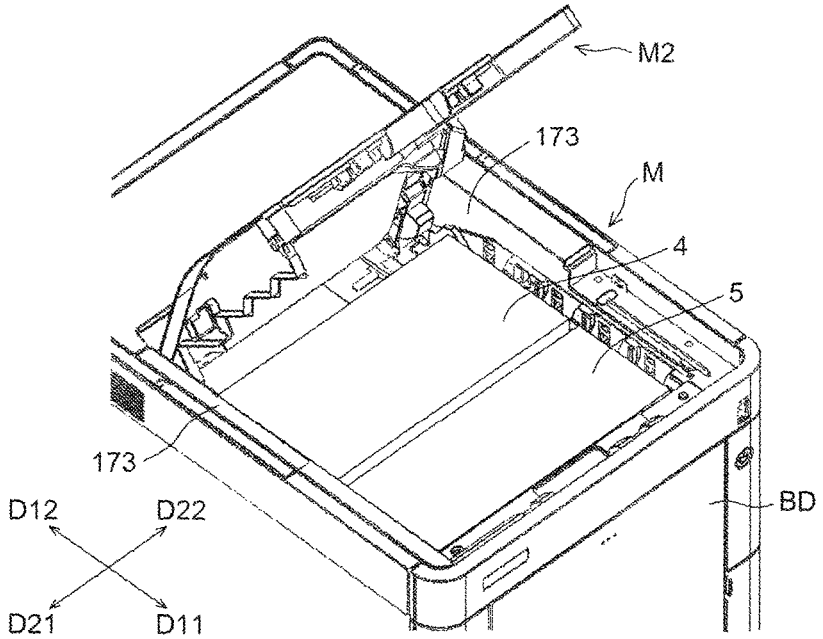
FIG. 4 is a diagram showing the upper part of the image forming apparatus according to one embodiment of the present disclosure as seen from the front side (the right side in FIG. 1), and is a diagram showing a state in which the top cover member is open.
Figure 5:
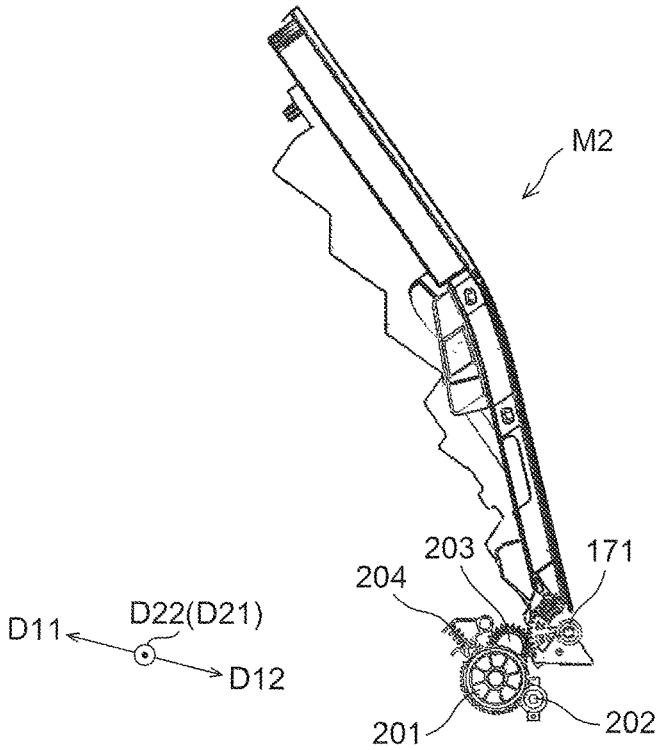
FIG. 5 is a diagram showing the top cover member in an open state in the image forming apparatus according to one embodiment of the present disclosure as seen from the right side of the top cover member.

As shown in FIG. 3, the top cover member M2 is provided with a rotary shaft 171. The rotary shaft 171 extends in the horizontal direction, and is rotatably supported on a second fixed frame 173 (see FIG. 4). As shown in FIGS. 4 and 5, the top cover member M2 is, with respect to the case body BD (the apparatus main body M), opened and closed about the rotary shaft 171 as a rotation center. Moreover, as shown in FIG. 6, the top cover member M2 is formed integrally with an engaging piece 175 which protrudes downward from the rotary shaft 171.

Figure 6:
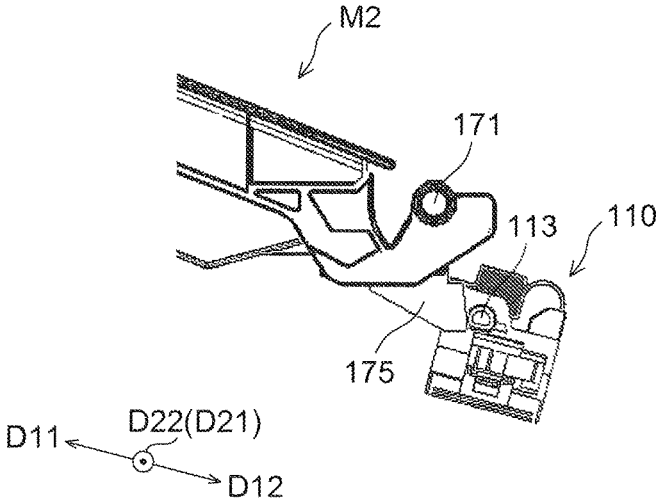
FIG. 6 is a diagram showing a state in which the top cover member is closed in the image forming apparatus according to one embodiment of the present disclosure, and is a diagram showing a left end part of the top cover member as seen from the right side of the top cover member.
Figure 7:
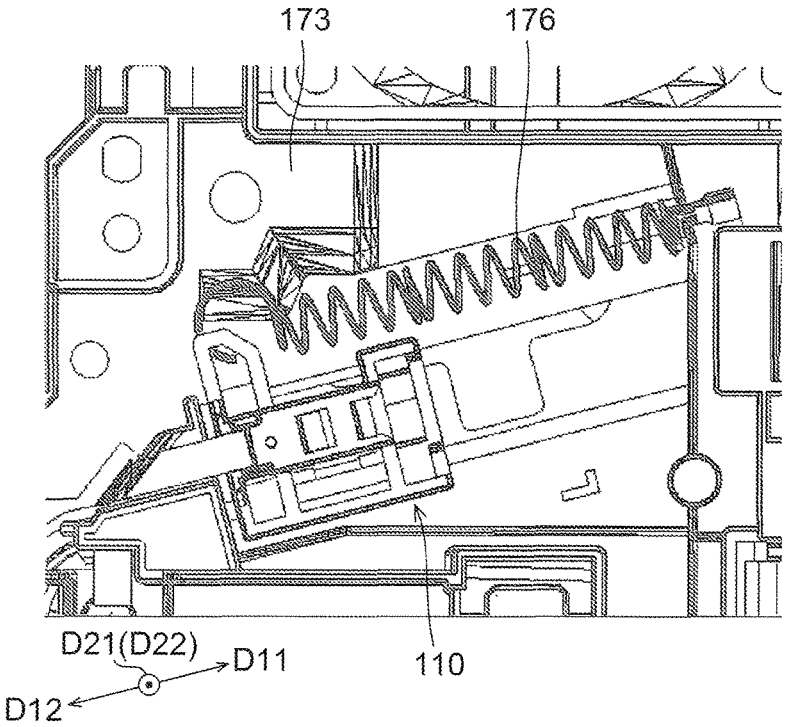
FIG. 7 is a diagram showing a state in which the top cover member is closed in the image forming apparatus according to one embodiment of the present disclosure, and is a diagram showing the left end part of the top cover member as seen from the left side of the top cover member.

In a left end part (an end part in a second positive direction D21) of the top cover member M2, as shown in FIGS. 6 and 7, there are provided, near the rotary shaft 171, a moving member 110 which reciprocates as the top cover member M2 is opened and closed, and a first biasing member 176 which applies a biasing force to the moving member 110.

The moving member 110 can reciprocate rectilinearly, along a rail portion formed on the second fixed frame 173, in a first positive direction D11 and a first negative direction D12 (the opposite direction to the first positive direction D11). Moreover, the moving member 110 is provided with a boss portion 113 which protrudes in the direction (a second negative direction D22) orthogonal to the first positive direction D11 and the first negative direction D12. The boss portion 113 is formed such that the engaging piece 175 of the top cover member M2 makes contact with it. Moreover, the first biasing member 176 is formed by an extension coil spring, whose one end is engaged with the second fixed frame 173 and whose other end is engaged with the moving member 110 so as to bias the moving member 110 in the first positive direction D11.

Figure 8:
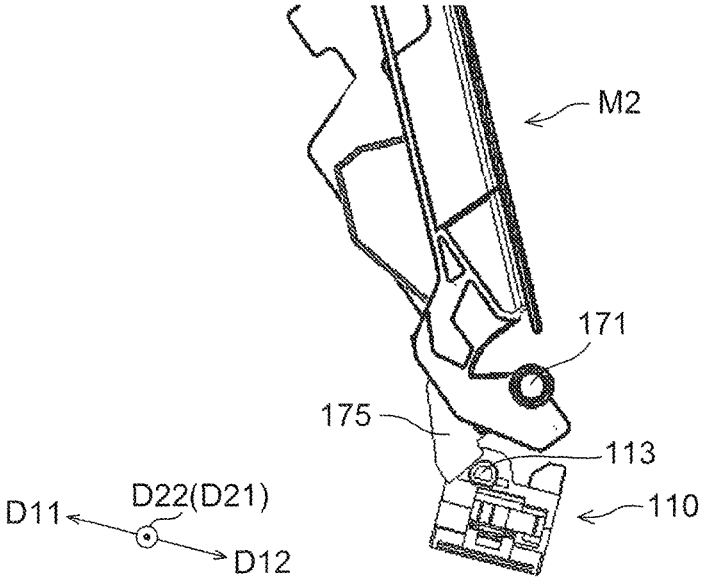
FIG. 8 is a diagram showing a state in which the top cover member is open in the image forming apparatus according to one embodiment of the present disclosure, and is a diagram showing the left end part of the top cover member as seen from the right side of the top cover member.
Figure 9:
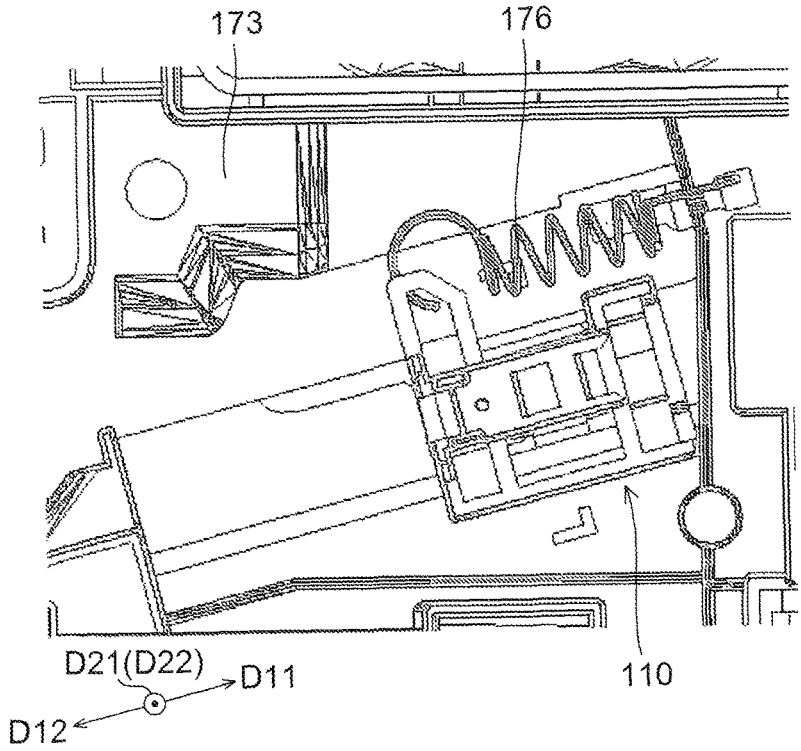
FIG. 9 is a diagram showing a state in which the top cover member is open in the image forming apparatus according to one embodiment of the present disclosure, and is a diagram showing the left end part of the top cover member as seen from the left side of the top cover member.

As the top cover member M2 is swung in the opening direction (the clockwise direction in FIG. 6), as shown in FIGS. 8 and 9, the moving member 110 moves in the first positive direction D11 with the boss portion 113 kept in contact with the engaging piece 175 of the top cover member M2. Here, the biasing force of the first biasing member 176 gradually decreases. On the other hand, as the top cover member M2 is swung in the closing direction (the counter-clockwise direction in FIG. 8), as shown in FIGS. 6 and 7, the moving member 110 moves in the first negative direction D12 by being pressed by the engaging piece 175 of the top cover member M2. Here, the biasing force of the first biasing member 176 gradually increases.

In a right end part (an end part in the second negative direction D22) of the top cover member M2, as shown in FIG. 3, there are provided, near the rotary shaft 171, a gear 201 which is coupled with the top cover member M2 and which rotates as the top cover member M2 is opened and closed, and a damper 202 which is coupled with the gear 201.

Figure 10:
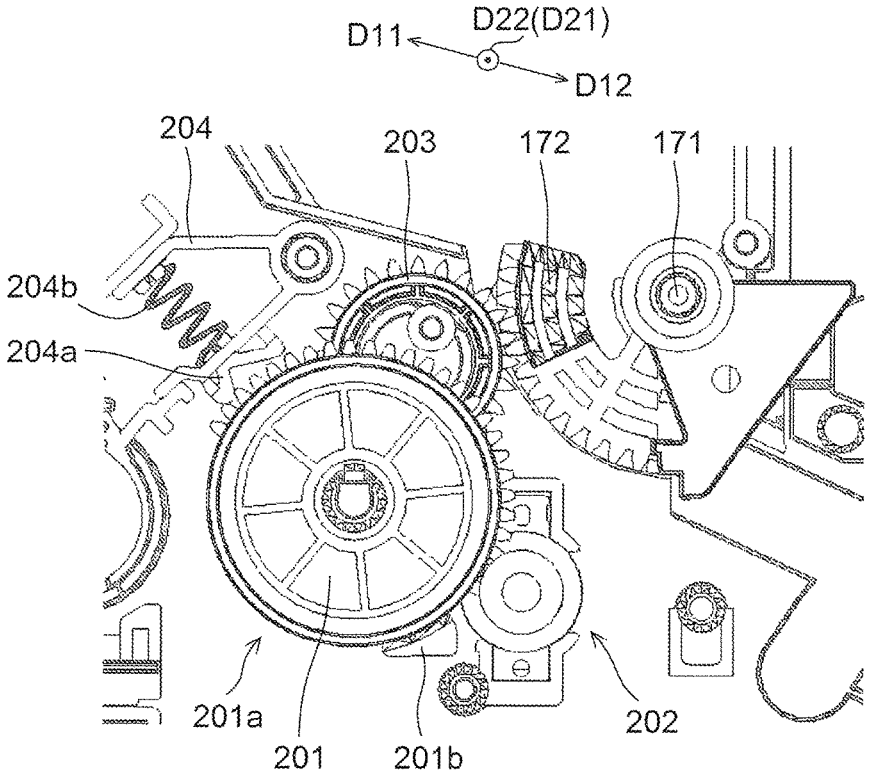
FIG. 10 is a diagram showing a state in which the top cover member is closed in the image forming apparatus according to one embodiment of the present disclosure, and is a diagram showing a periphery of a rotary shaft in a right end part of the top cover member as seen from the right side of the top cover member.

Specifically, as shown in FIG. 10, in the right end part of the top cover member M2, the rotary shaft 171 is formed integrally with a substantially fan-shaped cover gear 172. The cover gear 172 meshes with an intermediate gear 203. The intermediate gear 203 is coupled to the gear 201. For example, the gear 201 is formed as a two-stage gear, and the intermediate gear 203 meshes with a small-diameter gear (unillustrated) of the gear 201.

The damper 202 has a damper gear that is coupled with the gear 201 so as to suppress an increase in the rotation speed of the gear 201 by generating a load according to the rotation speed of the gear 201.

The gear 201 has an untoothed portion 201*a* where no teeth are formed. On the untoothed portion 201*a*, an engaging protrusion 201*b* in a substantially triangular shape is formed.

On the opposite side of the gear 201 from the damper 202, in the vicinity of the gear 201, a holding member 204 is provided that has an engaged portion 204*a* to be engaged with the engaging protrusion 201*b*. On the opposite side of the engaged portion 204*a* from the gear 201, a compression coil spring 204*b* is provided so that the engaged portion 204*a* can move over a short distance in a direction in which it moves toward and moves away from the gear 201.

Figure 11:
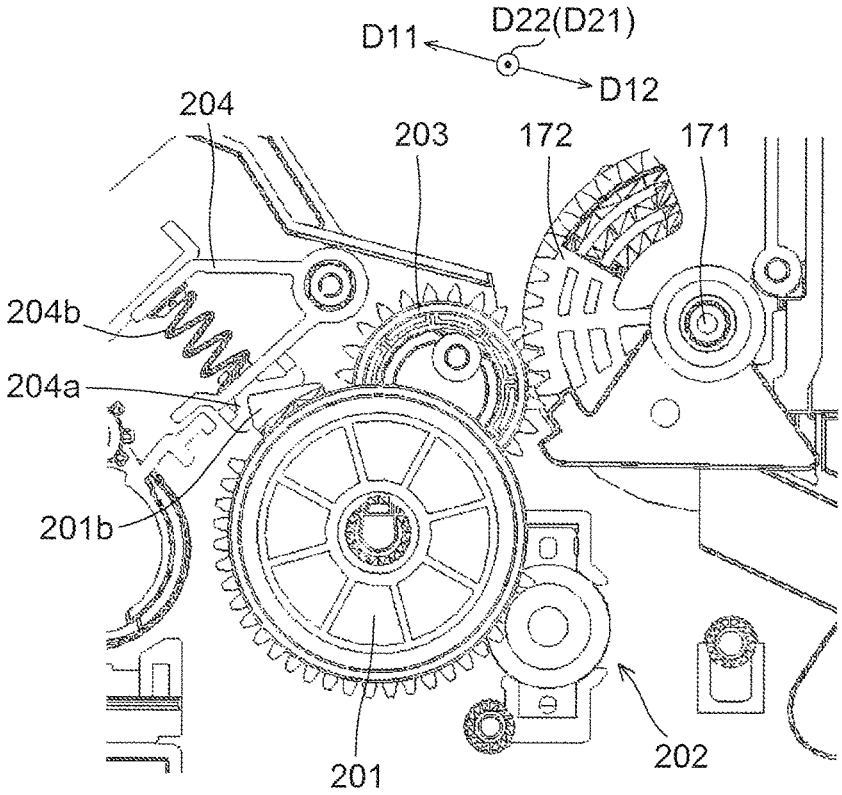
FIG. 11 is a diagram showing a state in which the top cover member is open in the image forming apparatus according to one embodiment of the present disclosure, and is a diagram showing a rotary shaft and the periphery thereof in a right end part of the top cover member as seen from the right side of the top cover member.

When the top cover member M2 is in the closed state (the state in FIGS. 3 and 10), the engaging protrusion 201*b* of the gear 201 is located in a position where it is not engaged with the engaged portion 204*a*. On the other hand, as the top cover member M2 is rotated in the opening direction (in the clockwise direction in FIG. 3), the intermediate gear 203 and the gear 201 rotate, and thus the engaging protrusion 201*b* approaches the portion 204*a*. Thus, as shown in FIG. 5, while the top cover member M2 is rotated through a predetermined angle (here about 60°) until it reaches a predetermined position (a completely opened position), the gear 201 is rotated through a predetermined angle (here about 180°), and as a result, as shown in FIG. 11, the engaging protrusion 201*b* is engaged with the engaged portion 204*a*. Thus, even when a user removes his or her hand from the top cover member M2, the top cover member M2 can be held in the opened state.

Next, the structure of the member moving mechanism 100 will be described.

Figure 12:
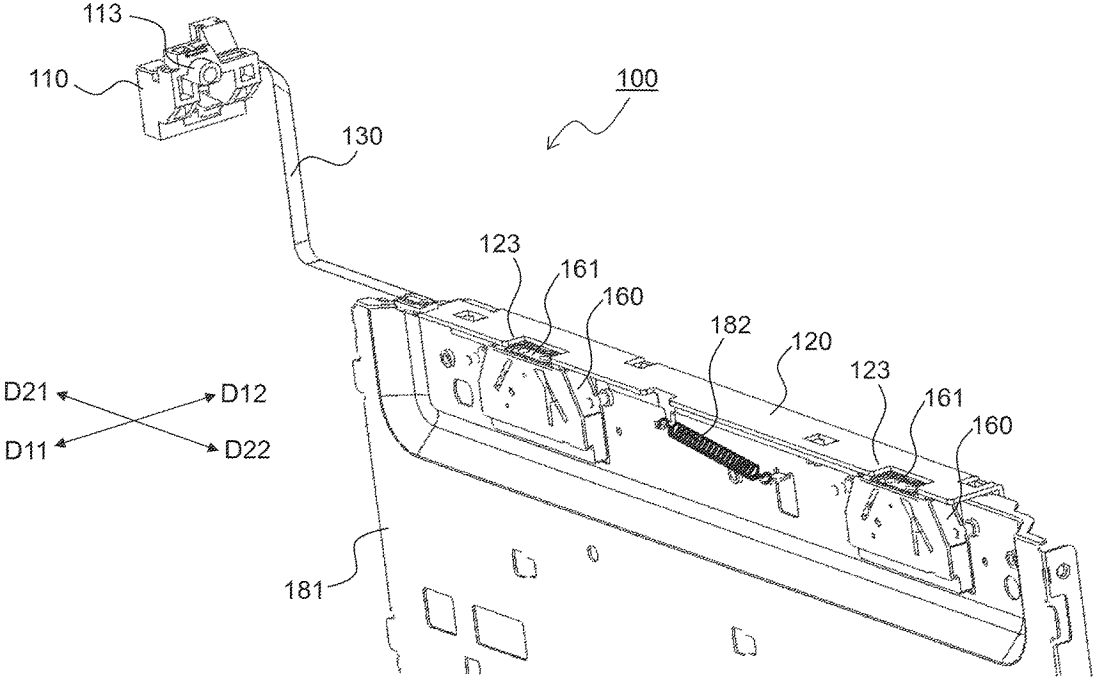
FIG. 12 is a diagram showing the overall structure of a member moving mechanism in the image forming apparatus according to one embodiment of the present disclosure.

As shown in FIG. 12, the member moving mechanism 100 includes the moving member 110, a moved member 120, a belt-form member 130, and a belt-form member guiding member 140 (see FIG. 14), which will be described later.

The belt-form member 130 is a member in the shape of a belt which couples the moving member 110 with the moved member 120. The belt-form member 130 is formed of a sheet-form material having flexibility. Thus, the bend radius of the belt-form member 130 can be made so small that the belt-form member 130 can be arranged in a minute gap or the like. This helps achieve space saving in the arrangement of the belt-form member 130, and thus helps achieve size reduction of the member moving mechanism 100. Examples of materials for forming such a belt-form member 130 include, for example, a resin member such as PET (polyethylene terephthalate), an elastic member such as rubber, a metal member, etc. The thickness of the belt-form member 130 is, for example, 1 mm or less.

The moved member 120 moves in a direction different from either of the first positive direction D11 and the first negative direction D12; specifically, it moves in the second positive direction D21 (the direction orthogonal to both the first positive direction D11 and the first negative direction D12), or moves in the second negative direction D22 which is the opposite direction to the second positive direction D21.

The moved member 120 is formed in the shape of a long strip and is swingably supported on the first fixed frame 181. The first fixed frame 181 constitutes a part of the case body BD (the apparatus main body M). The first fixed frame 181 extends in the second positive direction D21 and the second negative direction D22 of the moved member 120. Between the first fixed frame 181 and the moved member 120, there is stretched a second biasing member 182 which is formed by an extension coil spring that applies a biasing force to the moved member 120. The second biasing member 182 allows the moved member 120 to move, as the moving member 110 moves in the first positive direction D11, in the second positive direction D21 via the belt-form member 130. Moreover, the second biasing member 182, generates (charges) a biasing force with which, as the moved member 120 moves in the second positive direction D21, the moved member 120 moves so as to return in the second negative direction D22. Here, the biasing force of the second biasing member 182 is set weaker than the biasing force of the first biasing member 176.

Figure 13:
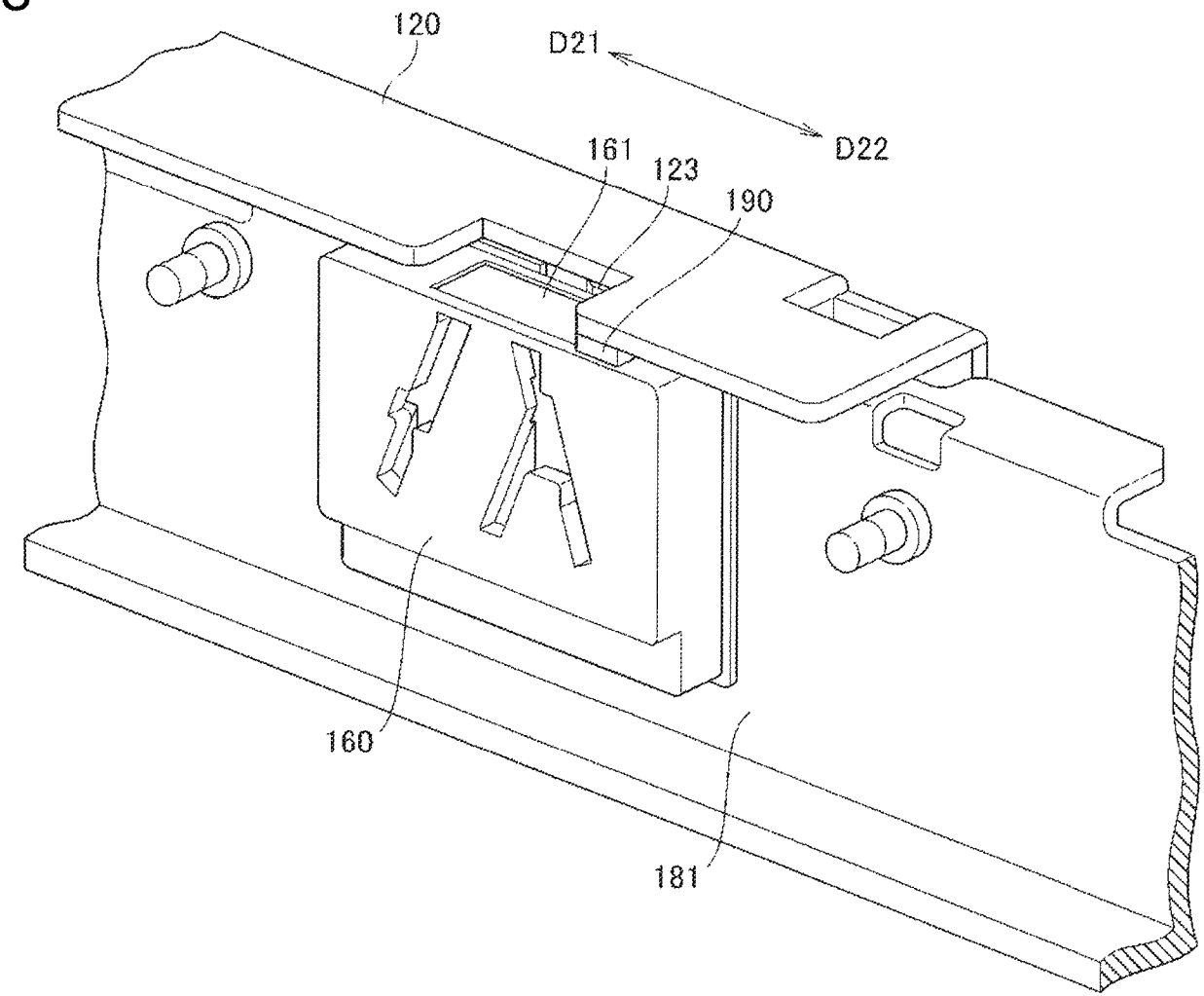
FIG. 13 is a diagram showing the structure of a wiper and the periphery thereof in the image forming apparatus according to one embodiment of the present disclosure.

As shown in FIGS. 12 and 13, an optical sensor 160 is fitted to the first fixed frame 181. The optical sensor 160 is, for example, a sensor for detecting image density. In the top surface of the optical sensor 160, there is arranged a light transmission window 161 made of a transparent member.

In the moved member 120, a cutout portion 123 is formed. The cutout portion 123 is formed so as not to shield the light emitted through the light transmission window 161 of the optical sensor 160 when the moved member 120 is located in a reference position (home position), that is, when the top cover member M2 is closed. To the bottom surface of the moved member 120 near the cutout portion 123, a wiper 190 as a cleaning member is fitted.

With the member moving mechanism 100 configured as described above, as the moved member 120 moves in the second positive direction D21 and the second negative direction D22, the wiper 190 fixed to the moved member 120 reciprocates while being in sliding contact with the light transmission window 161 of the optical sensor 160 so as to clean the light transmission window 161 as a cleaned member.

Figure 14:
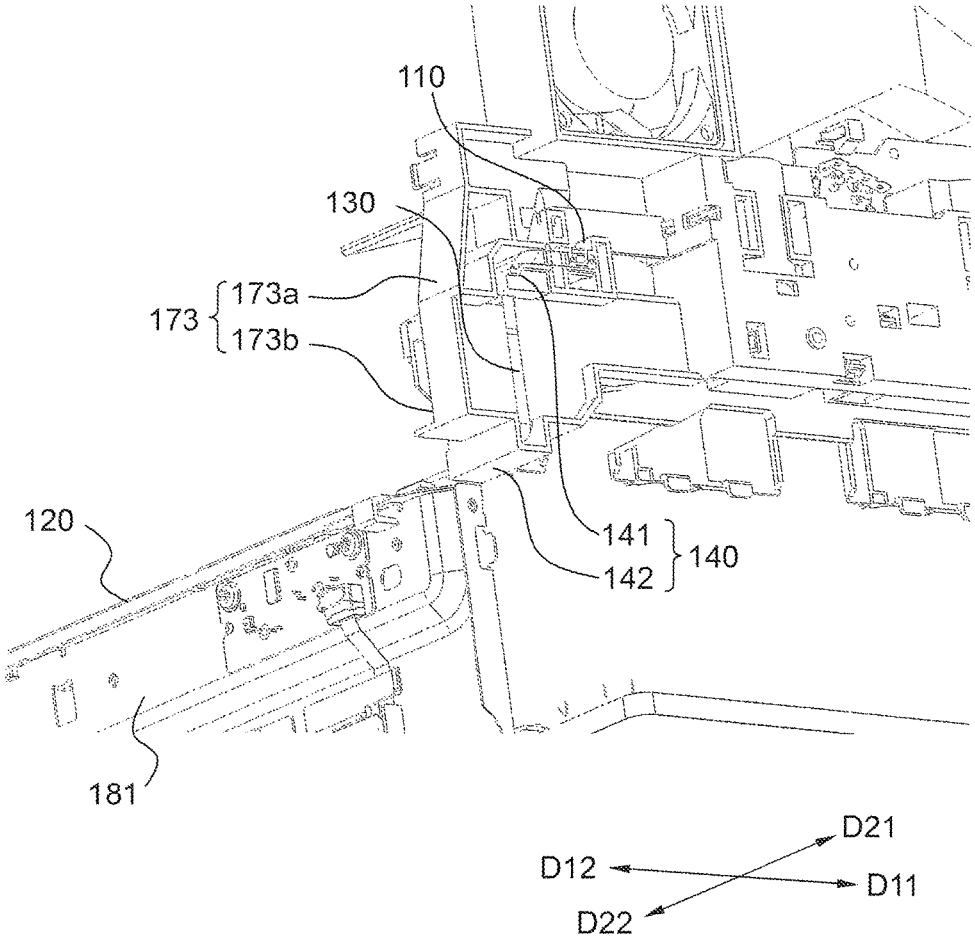
FIG. 14 is a diagram showing the structure of a moving member, a belt-form member, a belt-form member guiding member, and the periphery thereof in the image forming apparatus according to one embodiment of the present disclosure.

On the other hand, as shown in FIG. 14, the second fixed frame 173 is composed of an outer frame 173*a* and an inner frame 173*b*, and constitutes a part of the case body BD (the apparatus main body M). The outer frame 173*a* of the second fixed frame 173 is formed integrally with the belt-form member guiding member 140. The belt-form member guiding member 140 regulates the moving direction of the belt-form member 130 while being in sliding contact with the belt-form member 130, and changes the moving direction of the belt-form member 130 at least once (here twice).

Specifically, the belt-form member guiding member 140 is composed of an arc-form first guide member 141 and a second guide member 142 having a U-shaped section. The first guide member 141, while being in sliding contact with one side of the belt-form member 130, reverses the belt-form member 130 so as to change the moving direction of the belt-form member 130 substantially 90 degrees from a moving direction in which the belt-form member 130 moves horizontally with its reverse side aligned with the vertical plane to a moving direction in which the belt-form member 130 moves downward with its obverse side aligned with the vertical plane. The second guide member 142, while being in sliding contact with one side of the belt-form member 130, changes the moving direction of the belt-form member 130 substantially 90 degrees from the downward moving direction to a moving direction in which the belt-form member 130 moves horizontally with both its obverse and reverse sides aligned with the horizontal plane.

In this embodiment, as described above, there are provided the top cover member M2, the moving member 110 which, as the top cover member M2 is opened and closed, reciprocates while in contact with the top cover member M2, and the first biasing member 176 which biases in the first positive direction D11 the moving member 110 that moves in the first negative direction D12 as the top cover member M2 is rotated in the closing direction. With this configuration, the moving member 110 that moves in the first negative direction D12 as the top cover member M2 is rotated in the closing direction can be biased in the first positive direction D11 by the first biasing member 176, and it is thus possible to prevent an increase in the speed at which the moving member 110 moves in the first negative direction D12. As a result, even when a moment increases as the top cover member M2 is closed, the speed at which the top cover member M2 closes can be prevented from increasing, and thus an impact caused when the top cover member M2 is closed can be prevented from increasing.

Moreover, the first biasing member 176 biases the moving member 110 in the first positive direction D11, and thus a force acts on the top cover member M2 in the opening direction. This permits the top cover member M2 to be opened with a relatively weak force when it is opened.

There are provided the gear 201 which is coupled with the top cover member M2 and which rotates as the top cover member M2 is opened and closed, and the damper 202 which is coupled with the gear 201 and which suppresses an increase in the rotation speed of the gear 201 by generating a load according to its rotation speed. With this configuration, the speed at which the top cover member M2 closes can be prevented more effectively from increasing, and thus an impact caused when the top cover member M2 is closed can be prevented more effectively from increasing.

Moreover, as described previously, on the untoothed portion 201*a* of the gear 201, the engaging protrusion 201*b* is formed. When the top cover member M2 is rotated until it reaches the predetermined position, the engaging protrusion 201*b* is engaged with the engaged portion 204*a* of the holding member 204. Thus, the top cover member M2 can be held at the predetermined position (the predetermined angle).

As described previously, there are provided the moved member 120 that moves as the moving member 110 moves, the belt-form member 130 that couples the moving member 110 with the moved member 120, and the belt-form member guiding member 140 that regulates the moving direction of the belt-form member 130. With this configuration, in synchronization with opening/closing of the top cover member M2, the moved member 120 can be moved in the second positive direction D21 or the second negative direction D22.

Moreover, using the belt-form member 130 that is excellent in flexibility as a member that couples the moving member 110 with the moved member 120 makes it easy to avoid interference with a driving unit or a mechanism portion inside the image forming apparatus 1, thereby to enhance flexibility in the arrangement of the belt-form member 130. Furthermore, the belt-form member 130 allows easy determination of its bending direction; this makes it easy to arrange the belt-form member 130 when the member moving mechanism 100 is built in.

As described previously, there is provided the wiper 190 that moves as the moved member 120 moves. With this configuration, in synchronization with opening/closing of the top cover member M2, the light transmission window 161 can be cleaned.

It should be understood that the embodiments disclosed herein are in every aspect illustrative and not restrictive. The scope of the present disclosure is defined not by the description of embodiments given above but by the appended claims, and encompasses many modifications and variations made in the sense and scope equivalent to those of the claims.

For example, although an example has been dealt with in which the present disclosure is applied to a monochrome printer, this is not meant as any limitation. Needless to say, the present disclosure is applicable to various image forming apparatuses provided with a cover opening/closing mechanism including an opening/closing cover and a moving member, examples including color printers, color copiers, monochrome copiers, digital multifunction peripherals, facsimile machines, etc.

In the above-described embodiment, a configuration is adopted where one engaging protrusion 201*b* is provided on the gear 201 and one holding member 204 having the engaged portion 204*a* is provided so that the top cover member M2 is held in the state in FIG. 5; however, this is in no way meant to limit the present disclosure. Instead, two or more engaging protrusions 201*b* may be provided on the gear 201, or two or more holding members 204 may be provided. With such a configuration, the top cover member M2 can be held in a state (the state between FIGS. 3 and 5) in which the top cover member M2 is half open.

Although the above-described embodiment deals with an example where the moving member 110 and the moved member 120 are coupled with each other by the belt-form member 130; instead, the moving member 110 and the moved member 120 may be coupled with each other by use of a link mechanism or the like other than the belt-form member 130.

What is claimed is:

1. A cover opening/closing mechanism comprising:

an opening/closing cover which is pivotable about a rotary shaft;

a moving member which, as the opening/closing cover is opened and closed, reciprocates rectilinearly, while in contact with the opening/closing cover, in a first positive direction and in a first negative direction opposite to the first positive direction;

a first biasing member which biases in the first positive direction the moving member that moves in the first negative direction as the opening/closing cover is rotated in a closing direction thereof;

a gear which is coupled with the opening/closing cover and which rotates as the opening/closing cover is opened and closed; and a damper which is coupled with the gear and which suppresses an increase in rotation speed of the gear by generating a load according to the rotation speed.

2. An image forming apparatus comprising the cover opening/closing mechanism of claim 1.

3. The image forming apparatus of claim 2, further comprising:

a moved member which moves in a second positive direction different from either of the first positive direction and the first negative direction as the moving member moves in the first positive direction and which moves in a second negative direction opposite to the second positive direction as the moving member moves in the first negative direction;

a belt-form member which couples the moving member with the moved member;

a belt-form member guiding member which regulates a moving direction of the belt-form member; and a second biasing member which biases the moved member in the second negative direction, the second biasing member having a weaker biasing force than the first biasing member.

4. The image forming apparatus of claim 3, further comprising:

a cleaning member which is coupled with the moved member and which moves as the moved member moves; and a cleaned member which is cleaned by the cleaning member.

5. The cover opening/closing mechanism of claim 1, wherein the opening/closing cover has an engaging piece protruding downward from the rotary shaft, the moving member has a boss portion protruding in a direction orthogonal to the first positive direction and the first negative direction, and by the boss portion making contact with the engaging piece, the moving member makes contact with the opening/closing cover.

6. The cover opening/closing mechanism of claim 1, wherein the opening/closing cover is provided with an operation portion.

7. A cover opening/closing mechanism comprising:

an opening/closing cover which is pivotable about a rotary shaft;

a moving member which, as the opening/closing cover is opened and closed, reciprocates, while in contact with the opening/closing cover, in a first positive direction and in a first negative direction opposite to the first positive direction;

a first biasing member which biases in the first positive direction the moving member that moves in the first negative direction as the opening/closing cover is rotated in a closing direction thereof;

a gear which is coupled with the opening/closing cover and which rotates as the opening/closing cover is opened and closed;

a damper which is coupled with the gear and which suppresses an increase in rotation speed of the gear by generating a load according to the rotation speed;

a holding member which holds the opening/closing cover, wherein the gear has an untoothed portion where no teeth are formed, on the untoothed portion, an engaging protrusion is formed, and the engaging protrusion is, when the opening/closing cover is rotated to a predetermined position, engaged with an engaged portion of the holding member.

8. An image forming apparatus comprising the cover opening/closing mechanism of claim 7.

9. The image forming apparatus of claim 8, further comprising:

a moved member which moves in a second positive direction different from either of the first positive direction and the first negative direction as the moving member moves in the first positive direction and which moves in a second negative direction opposite to the second positive direction as the moving member moves in the first negative direction;

a belt-form member which couples the moving member with the moved member;

a belt-form member guiding member which regulates a moving direction of the belt-form member; and a second biasing member which biases the moved member in the second negative direction, the second biasing member having a weaker biasing force than the first biasing member.

10. The image forming apparatus of claim 9, further comprising:

a cleaning member which is coupled with the moved member and which moves as the moved member moves; and a cleaned member which is cleaned by the cleaning member.

* * * * *